United States Patent [19]

Varsos

[11] 4,319,087

[45] Mar. 9, 1982

[54] SECRET COMMUNICATION SYSTEM

[75] Inventor: Spyros G. Varsos, Maitland, Fla.

[73] Assignee: Martin Marietta Corporation, Orlando, Fla.

[21] Appl. No.: 583,288

[22] Filed: Sep. 30, 1966

[51] Int. Cl.[3] ..... H04K 1/00

[52] U.S. Cl. ..... 179/1.5 R; 178/22.01; 375/2.1

[58] Field of Search ..... 178/22, 69.5, 22.01; 179/1.5, 15 PCM, 1.5 R; 325/32, 42, 65, 122, 141, 142, 143; 340/348, 349, 355; 328/53; 332/9, 37, 1; 375/2.1

*Primary Examiner*—Richard A. Farley

*Attorney, Agent, or Firm*—Julian C. Renfro; Gay Chin

[57] ABSTRACT

This invention relates to a simplified pulse communication system for encrypting information to be transmitted over a communication link, which incorporates a novel randomizing and derandomizing procedure that is accomplished in the same step with PWM or PPM encoding and decoding.

13 Claims, 4 Drawing Figures

SECRET COMMUNICATION SYSTEM

There are in existence secret communication systems which employ the broad technique of modifying the pulse modulation in such a way that only authorized persons can detect the original modulating intelligence. However, these systems usually are not capable of encoding pulse position modulated (PPM) intelligence to provide an encrypted form of PPM signal which is transmitted and received in that form.

One means of converting intelligence in the form of PPM pulses to an encrypted form of intelligence-bearing PPM pulses is set forth in U.S. Pat. No. 4,152,545 by Roy E. Gilbreath et al. entitled "Pulse Position Modulation Secret Communication System" and assigned to the same assignee as the present application.

Another method of transmitting encrypted signals is to convert the intelligence signal into pulse code modulation (PCM) by means of an analog to digital converter and encoding the PCM. The encoded PCM may then be transmitted by Frequency Shift Keying (FSK), or the like, to a distant receiver which is equipped for the reverse process of demodulating to encrypted PCM and then converting the encrypted PCM to the original intelligence signal. This type of system has many advantages but will not operate with PPM modulation type systems.

The present invention advantageously incorporates a simple circuit for the encryption of intelligence bearing signals for transmission in pulse position modulation, pulse duration modulation (PDM), or the like. The simplicity of the present system also makes it readily adaptable for combining with other types of coding systems.

The present invention provides for encrypting intelligence bearing signals in which the intelligence bearing signals are converted into Pulse Amplitude Modulated signals. The PAM pulses are compared with a randomly interrupted waveform to produce Pulse Width Modulated pulses (PWM). The PWM pulse may then be gated to produce a Pulse Position Modulated signal prior to transmission over a communication link or the PWM may be transmitted directly.

The present system of encrypting intelligence advantageously simplifies hardware design in a secret communication system by incorporating the randomizing and derandomizing in the same step with the PWM or PPM encoding and decoding processes respectively. It thereby offers a considerable gain in simplicity over previously proposed methods.

The present system is also compatible with Error Elimination Techniques used in the receiver of communication systems. Every pulse received is decrypted and an optimum selection can be made through voice statistics.

Other objects, features and advantages of this invention will be apparent from a study of the written description and the drawings in which.

Figure 1:
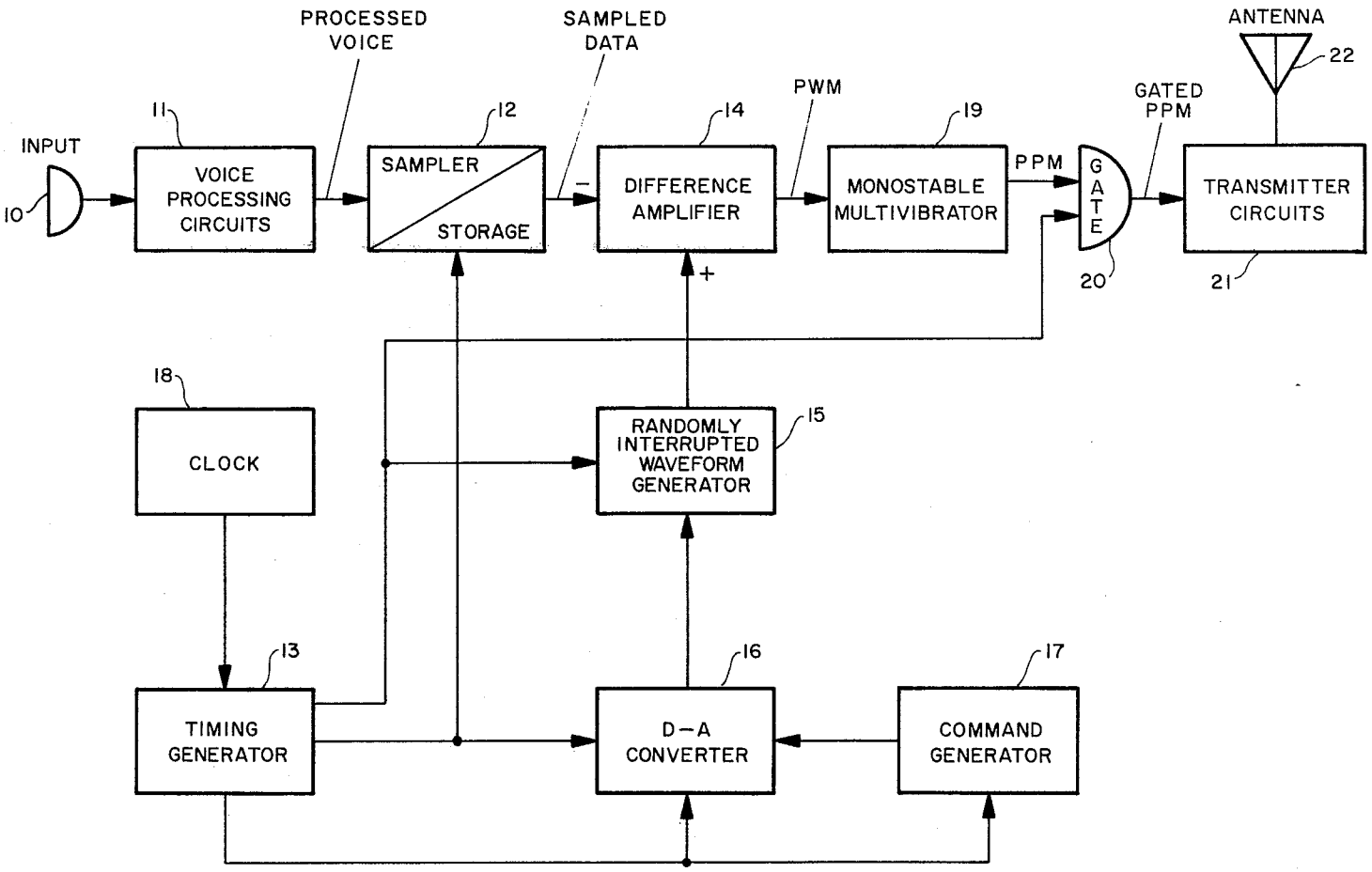
FIG. 1 is a block diagram of an embodiment of a transmitter.

Referring to the transmitter circuit of FIG. 1, voice input is received at a transducer 10 such as a microphone which produces the voice signal and is fed to the voice processing circuits 11. The voice processing circuits 11 may feed the audio inputs of audio amplifiers and filters and may also contain a preemphasis circuit. An amplifier is selected to provide gain and filtering of the signals.

Processed voice signals leaving the voice processing circuits 11 are impinged upon the sampler/storage circuit 12. Sampling is used to convert processed voice signals into pulse amplitude modulated signals which are momentarily stored. Sampling is done by gates which are sampled in sequence through control logic from the timing generator 13. The pulse amplitude modulated signals are fed to a difference amplifier 14, which amplifier is also fed signals from randomly interrupted waveform generator 15.

The sampler and storage circuit 12 samples the input processed voice waveform at sampling period intervals and generates the sampled data waveform corresponding to the processed voice waveform at the input. The sampling period timing information is provided from the timing generator circuit 13.

The difference amplifier circuit 14 translates the amplifier information contained in the sampled data waveform appearing at the input into pulse-width modulation (timing information). Pulse-width modulation may easily be converted to pulse position modulation since the start of the PWM pulse is what varies and the end of the PWM pulse remains fixed. PPM is generated from PWM by eliminating the variable width of the PWM pulses and making all pulses the same. The time occurrence of the pulse carries the amplitude information of the signal to be transmitted.

The amplitude-to-time translation is facilitated through the use of the input from the randomly interrupted waveform generator circuit 15 to the input to circuit 14, which input is a waveform with its amplitude varying with time in accordance with a given relationship. This waveform for a linear relationship of amplitude versus time takes the form of a periodic sawtooth. The period of this waveform is synchronized in phase and frequency with the sampling frequency. If the deviation period chosen is less than the sampling period then the sawtooth starts sometime during the sampling period and ends before the period is over.

If the waveform used for the amplitude-time translation is linear except that the initial condition is different from the reference level then the resulting waveform is an interrupted sawtooth. Furthermore, this sawtooth interruption, which is related to the occurence in time of the initial starting condition, can be varied randomly in time from period to period if the initial starting level is also varied accordingly. This waveform is referred to in this application as a randomly interrupted waveform.

Comparison of the randomly interrupted waveform with the signal sampled data waveform in a comparing means such as difference amplifier circuit 14 generates the PWM waveform which is converted to a PPM pulse train by the monostable multivibrator circuit 19. As can be seen at this point, the signal data is encrypted, inasmuch as the same randomly interrupted waveform will be required in order to decode the PWM or PPM pulses back to the original signal. The randomly interrupted waveform may be continuously varied to prevent unauthorized interception of the message.

Gate circuit 20 allows only the pulses generated within the deviation period to go through for transmission. This gate eliminates all other pulses outside the deviation limits.

The randomly interrupted waveform generator circuit 15 receives the initial starting level for the interrupted sawtooth waveform from the digital-to-analog converter 16 and the timing generator 13 feeds the timing information for beginning and ending the sampling and deviation periods.

Randomly interrupted waveform generator 15 is fed a voltage bias from the digital to analog (D-A) converter 16 which bias determines the starting voltage bias at the beginning of the deviation period for the waveform issued by the generator 15. This bias may be varied from sampling period to sampling period in accordance with a prescribed random manner for the transmitter by the compound generator 17. By varying the waveform of generator 15 in a prescribed random manner in both transmitter and receiver, detection by unauthorized receivers is made highly improbable. Timing generator 13 supplies timing information to the D-A converter 16 for the translation of the random digital code to the random analog level and also supplies timing pulses to the command generator 17 for synchronous shifting of the random digital numbers. The command generator 17 supplies a code which is also supplied simultaneously at the receiver by a similar circuit, which is continuously kept in synchronism. Digital to analog converters are well known in the art and may be a logic circuit combined with a resistor ladder which converts digital information to a voltage analog.

The clock 18 may be any basic clock pulse generator such as a crystal controlled oscillator or the like. The output of the basic clock is the reference frequency for the timing generator 13 which forms the timing pulses. The clock 18 may have some multiple of an 8 kc basic frequency divided down to yield the necessary lower frequencies. While an 8 kc frequency is illustrated it should be clear that other timing frequencies may also be used without departing from the spirit of the invention. The timing generator may be ring counters or the like.

The pulse width modulated pulse train issuing from the difference amplifier 14 is directed into a monostable multivibrator 19 which converts the PWM to pulse position modulation. It should of course be clear that pulse width modulation could be transmitted without conversion to PPM and that converting could be to any form other than PPM without departing from the spirit and scope of the invention. PWM however involves a variation of the duty cycle of the transmitter that reduces the operating efficiency of the equipment and therefore is not commonly used. The monostable multivibrator of course initiates a pulse of controlled width. It has a stable and an unstable state and an input pulse shifts the condition from the stable to the unstable state. At the end of the required holding time, the circuit automatically reverts to the stable condition.

Gate 20 has two inputs, one from the timing generator 13 and one from the multivibrator 19. Gate 20 is a logic "AND" gate so that upon receiving pulses from both inputs simultaneously, it issues an output pulse to the transmitting circuits 21 and subsequently to the antenna 22 for the transmission over a communication link.

The transmitting circuit is a typical pulse transmitter and may consist of an exciter and power amplifier. The exciter may be a crystal or self-exciting oscillator that generates the carrier frequency of the transmitter. The output of the exciter is fed directly to a power amplifier and then to the antenna 22.

Figure 2:
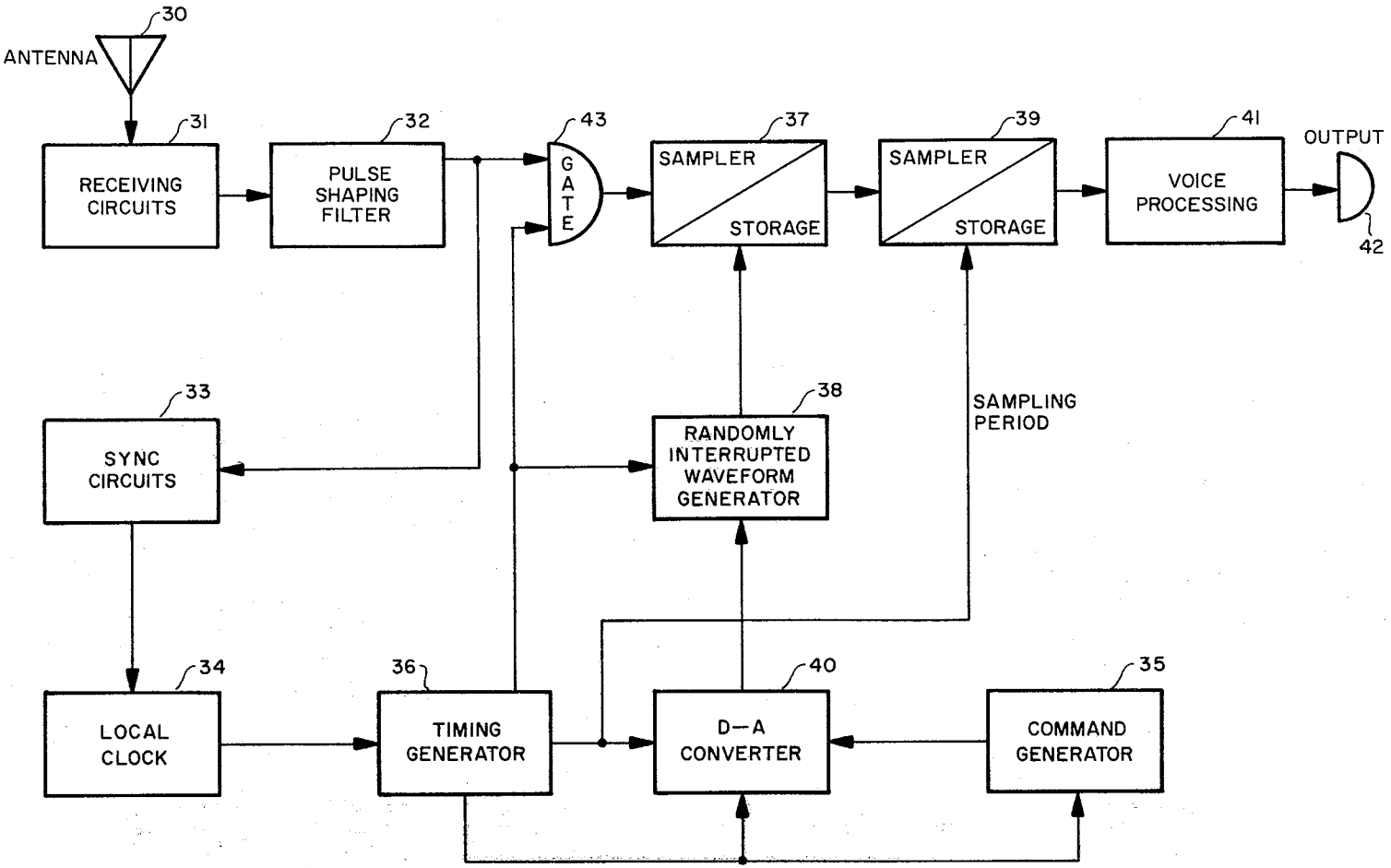
FIG. 2 is a block diagram of one embodiment of a receiver of the present invention.

Turning now to FIG. 2, the receiver for the present system may be seen in block diagram form and has an antenna 30 to receive radio frequency signals transmitted by a transmitter similar to the one in FIG. 1. The antenna feeds the receiving circuits 31 which contain the usual receiver circuits including the RF amplifier for the amplification of the received RF signals, the converter for converting the incoming RF signal into a lower carrier or IF frequency, the IF amplifiers for obtaining gain in the intermediate frequency and the detector for the detection and demodulation of the IF signals. The processed and demodulated signals are fed from the receiving circuits 31 to the pulse shaping filter 32, which restores the transmitted pulses and may be a low pass filter such as a passive L-C network. If wide pulses are to be received a pulse peak detector may be used in place of the pulse shaping filter 32. This circuit detects the peak in amplitude of each pulse passing through the circuit.

The pulse shaping filter feeds the synchronization circuits 33 which must synchronize the local clock in phase and frequency. Circuit 33 synchronizes the clock 34 which is identical to the one described for the transmitter and which synchronizes the timing generator 36 and in turn also synchronizes the command generator 35 with the command generator of the transmitter. The command generators are also alike in both transmitter and receiver.

The timing pulse from timing generator 36 which is impinged upon the gate 43 allows the passage of the PPM pulses within the deviation period, but of course any noise pulses falling outside are eliminated. The sampling circuit 37 samples the waveform from the randomly interrupted waveform generator 38 each time a pulse is received from gate 43. This is a nonuniform sampling and thus a second sampler/storage circuit 39 is provided to sample at a uniform sampling period determined by an input from the timing generator 36.

Randomly interrupted waveform generator 38 is the same as the one in the transmitter and produces a randomly discontinuous or interrupted wave which may be of a generally sidewise broken "Z" shape. Sampler/storage circuit 39 has its output connected to the voice circuits 41.

As can be seen at this point, the receiver demodulation is basically the opposite of the coding performed at the transmitting end of the system. The circuits used for decoding are very similar to those used for the coding except for the reverse flow of signals. The signals produced by samplers 37 and 39 are generally pulse amplitude modulated. The output from sampler/storage circuit 39 after filtering and processing constitutes the received signal. The voice processing circuits 41 will generally contain the de-emphasis circuits with the usual audio amplifiers with a voltage amplifier followed by a power amplifier which drives a transducer 42.

Figure 3:
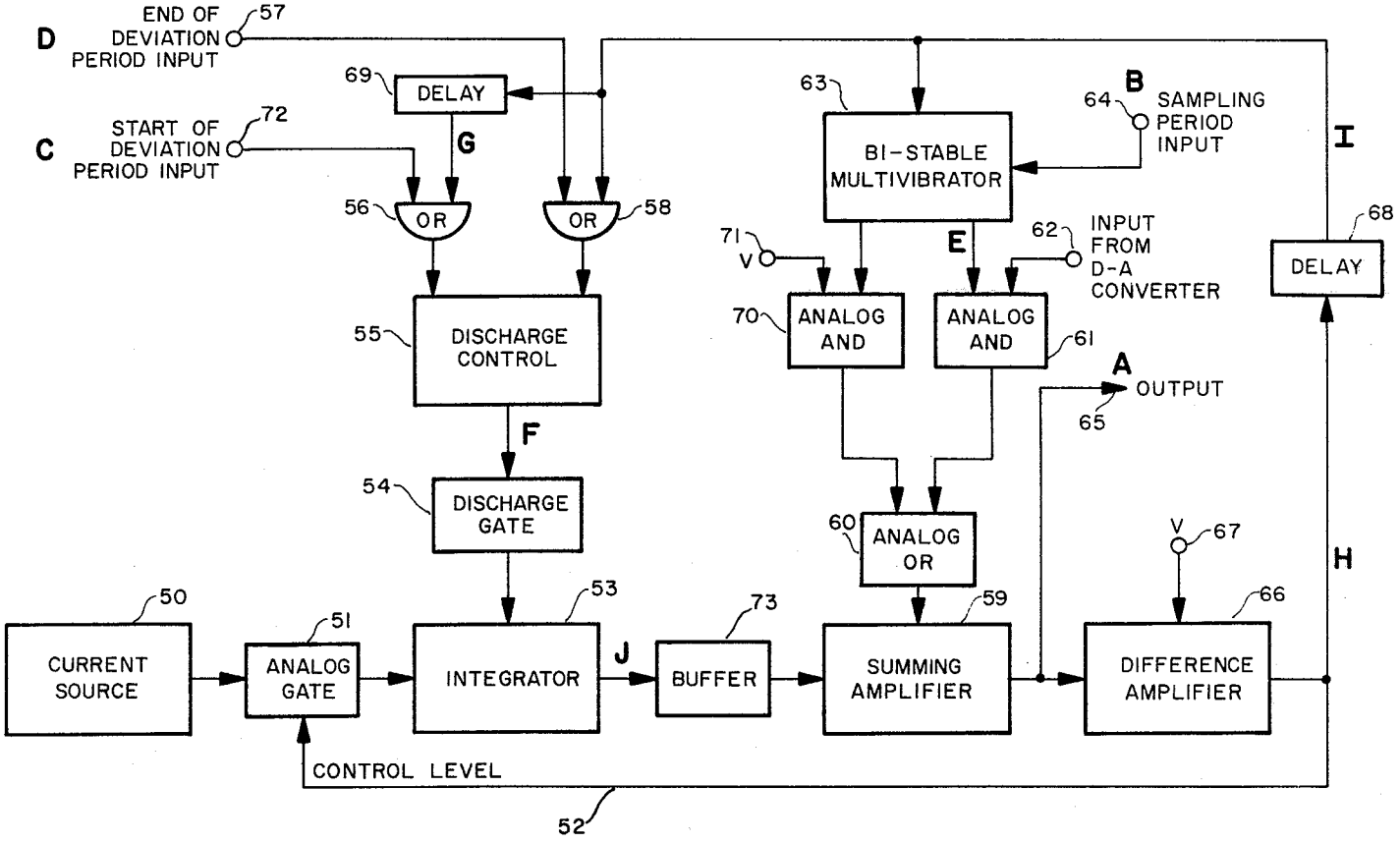
FIG. 3 is a block diagram of randomly interrupted waveform generator that may be used in the embodiments of FIGS. 1 and 2.
Figure 4:
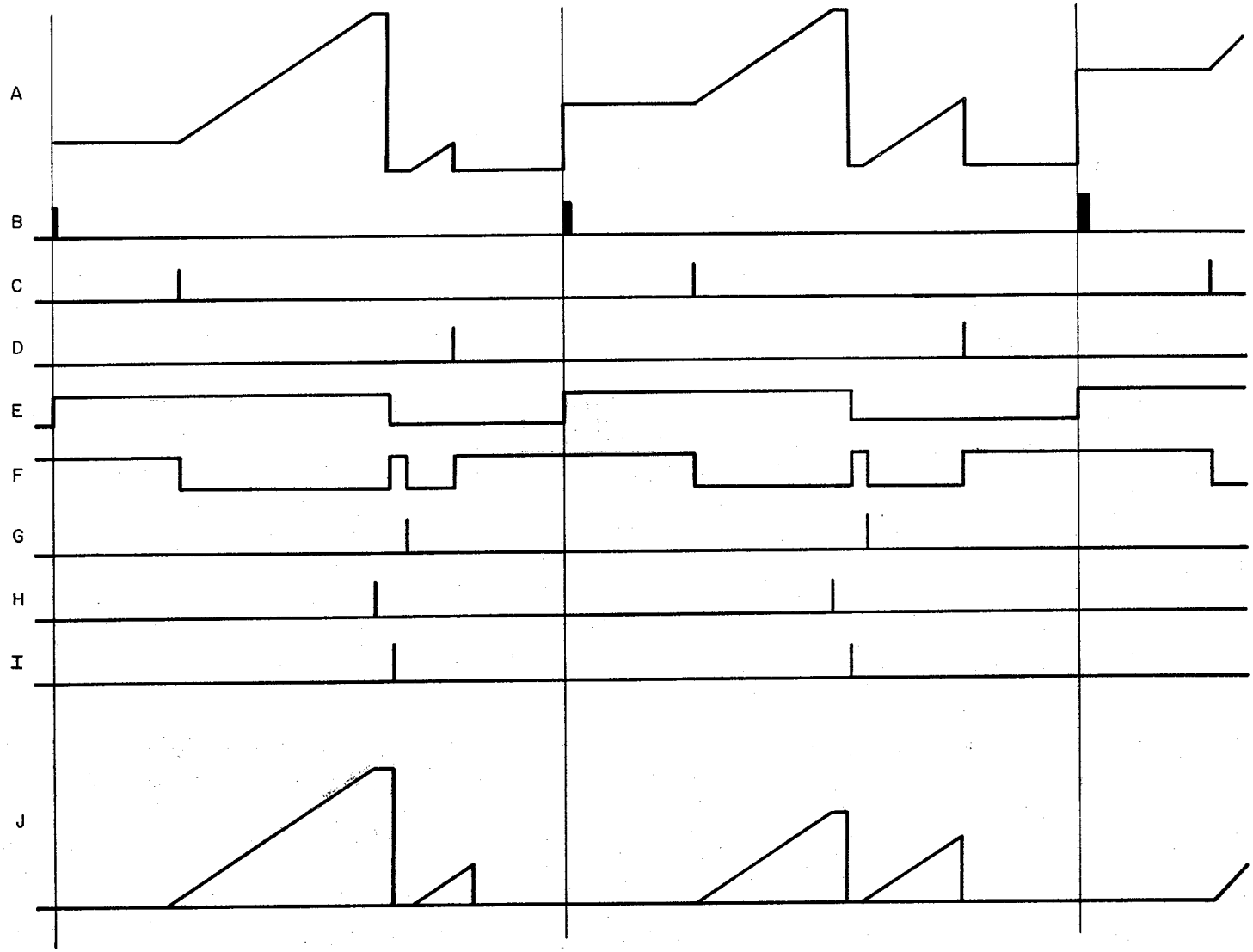
FIG. 4 shows the pulses at different points of the waveform generator of FIG. 3.

Referring now to FIGS. 3 and 4, one embodiment of a randomly interrupted waveform generator and the pulses it produces at different points is shown. While any design of randomly interrupted waveform generator may be used, one preferred example is illustrated which may be used in the transmitter circuit of FIG. 1, Block 15, and in the receiver circuit of FIG. 2, Block 38.

In FIG. 3, the current source 50 may be a constant current generator, the current from which is passed through analog gate 51 which may be a field effect transistor (FET) with the control level input 52 connected to the base electrode. The FET maintains a low impedance for current passing through the gate which current will normally pass to integrator 43 unless a control voltage is placed upon the base electrode.

Integrator 53 may be a simple R-C circuit and is a storage circuit in which the output voltage is proportional to the total amount of energy stored. For example, the voltage across a capacitor is proportional to the total charge in it. The greater the amount of charge, the higher the voltage across the capacitor. If a constant current is applied to the capacitor the voltage across the capacitor increases at a constant rate. The integrator 53 will start charging or be discharged depending upon the discharge gate 54 which in turn is controlled by the discharge control 55. Discharge control 55 is a flip flop or bistable multivibrator which remains in one of two stable states until a switching pulse is received from either of its two inputs. A pulse received at input 72 passes through the OR gate 56 and switches the discharge control 55, thus placing a voltage on discharge gate 54 which in turn prevents discharge of the integrator 53 and allows the integrator to start charging. The deviation period comes to an end upon a pulse being received at input 57 which passes through OR gate 58 and switches the flip flop 55 to its second bistable conditions, and thus removing the voltage from gate 54 and discharging the integrator 53.

The integrator 53 has its output impinged upon buffer amplifier 73 which isolates any loading effects that the summing amplifiers 59 may present to the integrator circuit 53.

Summing amplifier 59 sums the voltage of its two inputs, one of which will be a linearly rising voltage when the integrator is charging. The other will be a constant voltage that is varied in steps upon input commands. This latter input is received from analog OR gate 60 and determines the voltage level at the beginning of the deviation period. The analog OR gate 60 has one input from an analog AND gate 61 which has one input from input 62 from the D-A converter (FIGS. 1 and 2). The other input to gate 61 is from bistable multivibrator or flip flop 63 which is switched to the gate 61 side by a sampling period pulse received at input 64.

The summing amplifier 59 produces the randomly interrupted waveform generator output signal at 65 and supplies the same voltage to a difference amplifier 66. A second voltage is placed upon the difference amplifier 66 by input 67 which voltage determines the upper limit to which the linearly rising voltage from integrator 53 may arise. The difference amplifier determines the difference between the two input voltages and acts as a threshold detector so that upon the upper extreme level voltage of 67 being reached, an output signal will be supplied at the output from amplifier 66. This output is fed to the analog gate 51 which discontinues the current from source 50 and maintains the voltage in the integrator 53 momentarily constant. This in turn maintains the output 65 momentarily constant. Amplifier 66 also has its output connected to delay circuit 68 which provides a short delay by means of a delay line or the like. The voltage from delay circuit 68 is fed to OR gate 58 which will discharge the integrator 53 as already described. The voltage from delay 68 is also fed to a second delay circuit 69 which also provides a short delay be means of a delay line. This delay is connected to OR gate 56 for restarting the just discharged integrator 53 as described earlier.

The voltage from delay 68 is also connected to flip flop 63 and serves to switch it to the other stable state thereby activating an analog AND gate 70 which already has a DC voltage placed upon it from input 71. Analog AND gate 70 thus produces an output which passes through analog gate 60 and maintains the lower level voltage at summing amplifier 59 and at output 65 upon discharge of the integrator 53.

After discharging and restarting integrator 53, it will continue recharging until a pulse is received at input 57 which signals the end of the deviation period and discharges the integrator 53.

As can be seen, a randomly interrupted waveform generator has been provided which may have its waveform randomly varied by varying the input voltage level received at input 62 which varies the voltage level at which the deviation period begins. This voltage level may be varied by a command generator which may be coded as desired. Inputs 72 and 57 beginning and ending the deviation period and input 64 determining the sampling period are received from the timing generators of either FIG. 1 or FIG. 2.

Referring to FIG. 4, sample waveforms at different points in the waveform generator of FIG. 3 are identified by letters of the alphabet which are keyed to the appropriate points on FIG. 3. For instance, an example of the output of the randomly interrupted waveform generator as would appear at output 65 of the generator of FIG. 3 is shown at A. The shape of waveform A is controlled by the waveforms B-J appearing at different points in the waveform generator.

Sample period pulses B received at input 64 determine the beginning and end of each sample period by switching flip flop 63 to produce pulses E which act with the DC voltage input from input 62 to determine the voltage level of waveform A between the beginning of the sampling period and the beginning of the deviation period. The deviation period is initiated by pulse C being received at input 72 which switches the flip flop 55 to produce a voltage as shown at F. Flip flop 55 is switched back again by a pulse D received at 57 and signaling the end of the deviation period. These pulses received at OR gates 56 and 58 initiate the charging and discharging of integrator 53 which of course produces the deviation or rising voltage as shown in the voltages in waveforms A and J. Pulse H received from difference amplifier 66 will discontinue the current from the current source 50 and produce the momentary constant voltage level at the top of the output waveform A. Pulse I is pulse H delayed for a short period of time and pulse G is pulse I delayed for a short period by delay line 69 and determines the length of time the voltage remains constant after discharge. Integrator 53 output is illustrated at J and produces a voltage rising at a constant rate as long as a constant current is applied to the integrator. A plateau is produced by merely shutting off the input current flow. The sudden drop in voltage is of course accomplished by discharging the integrator as described.

From the foregoing description it will be clear that a pulse communication system has been provided for encrypting information to be transmitted over a communication link. The system as described has a wide range of application in secret communication between two or more points in which it is desired to prevent unauthorized sources from intercepting messages. It is to be understood that other variations are contemplated as being within the spirit of the invention. For instance, while one form of randomly discontinuous waveform generator is provided, others may also be used and while a PPM system is described, PWM or any other system that varies pulses in accordance with time may be used.

This invention is not to be construed as limited to the particular forms disclosed herein, since these are to be regarded as illustrative rather than restrictive.

I claim:

1. An apparatus for encrypting an intelligence bearing signal comprising:

(a) conversion means for converting intelligence bearing signals into pulse amplitude modulated pulses;

(b) randomly interrupted waveform generation means for generating a randomly interrupted waveform; and (c) comparing means for comparing the output of said randomly interrupted waveform generation means with the output from said conversion means to produce encrypted pulse width modulated pulses.

2. The apparatus according to claim 1 but including a second conversion means for converting said pulse width modulated pulses into pulse position modulated pulses.

3. The apparatus according to claim 2 but including transmission means for transmission of said PPM pulses over a communication link.

4. The apparatus according to claim 3 but including command generator means for producing the randomization commands for said randomly interrupted waveform generation means.

5. The apparatus according to claim 4 in which said command generator means produces digital commands.

6. The apparatus according to claim 5 but including a digital to analog conversion means for converting said digital commands for said command generation means into a voltage analog.

7. A method of encrypting intelligence bearing signals in a communication system comprising the steps of:

(a) converting intelligence bearing signals into pulse amplitude modulated pulses;

(b) generating a randomly interrupted waveform; and (c) comparing said pulse amplitude modulated pulses with said randomly interrupted waveform to produce encrypted pulse width modulated pulses.

8. The method according to claim 7 but including the step of converting said pulse width modulated pulses to pulse position modulated pulses.

9. The method according to claim 8 but including the step of transmitting said PPM pulses over a communication link.

10. A communication system for the transmission of encrypted intelligence bearing signals, comprising:

(a) conversion means for converting intelligence bearing signals to pulse amplitude modulated pulses;

(b) first waveform generator means for producing a randomly discontinuous waveform;

(c) difference amplification means for comparing the output of said conversion means with the output of said waveform generation means to produce time varying pulses;

(d) transmission means for transmitting said time varying pulses over a communication link;

(e) reception means for the reception of said time varying pulses;

(f) second waveform generation means for producing a randomly discontinuous waveform; and (g) sampling means for sampling said randomly discontinuous waveform whenever a said time varying pulse is received from said reception means said reception means being adapted to decode said pulses transmitted by said transmission means.

11. The communication system according to claim 10 in which said time varying pulses are PWM.

12. The communication system according to claim 10 in which said time varying pulses are PPM.

13. The communication system according to claim 10 in which said first and second waveform generation means each include a command generator means for the randomization of said waveform generation.

* * * * *